US008544885B2

(12) United States Patent
Lanting et al.

(10) Patent No.: US 8,544,885 B2
(45) Date of Patent: Oct. 1, 2013

(54) FOLDING PARKING STAND

(75) Inventors: Henry Albert Lanting, Dunnville (CA); Radu Traian Guja, Welland (CA); Scott Robert Jamieson, Welland (CA); Henry Friesen, Niagara-on-the-Lake (CA)

(73) Assignee: Deere & Company, Moline, IL (US)

( * ) Notice: Subject to any disclaimer, the term of this patent is extended or adjusted under 35 U.S.C. 154(b) by 687 days.

(21) Appl. No.: 12/635,090

(22) Filed: Dec. 10, 2009

(65) Prior Publication Data

US 2011/0140402 A1 Jun. 16, 2011

(51) Int. Cl.
*B60S 9/02* (2006.01)

(52) U.S. Cl.
USPC ..... 280/763.1; 414/686; 172/274; 292/127

(58) Field of Classification Search
USPC ..... 280/763.1, 764.1; 414/686, 680; 172/274, 481; 37/443, 232; 292/127, 121, 292/107, 80
See application file for complete search history.

(56) References Cited

U.S. PATENT DOCUMENTS

| | | | | | |
|---|---|---|---|---|---|
| 2,627,433 | A * | 2/1953 | Wolfe | ..... | 292/127 |
| 4,051,962 | A * | 10/1977 | Westendorf | ..... | 414/686 |
| 4,257,730 | A | 3/1981 | Kawakita | | |
| 4,275,984 | A * | 6/1981 | Lenertz | ..... | 414/686 |
| 4,337,015 | A * | 6/1982 | Friesen et al. | ..... | 414/686 |
| 4,347,031 | A | 8/1982 | Friesen et al. | | |
| 4,498,839 | A * | 2/1985 | Williams et al. | ..... | 414/686 |
| 4,522,554 | A * | 6/1985 | Williams et al. | ..... | 414/686 |
| 4,798,511 | A * | 1/1989 | Kaczmarczyk et al. | ..... | 414/686 |
| 5,531,561 | A * | 7/1996 | Rae et al. | ..... | 414/686 |
| 5,575,492 | A * | 11/1996 | Stone | ..... | 280/475 |
| 6,231,295 | B1 * | 5/2001 | Girstenbrei et al. | ..... | 414/686 |
| 6,247,888 | B1 * | 6/2001 | Guiet | ..... | 414/686 |
| 6,827,335 | B1 * | 12/2004 | Medberry | ..... | 254/425 |
| 7,219,914 | B2 * | 5/2007 | Huddleston | ..... | 280/475 |
| 7,354,238 | B2 * | 4/2008 | Fukudome et al. | ..... | 414/686 |
| 8,162,586 | B2 * | 4/2012 | Webb et al. | ..... | 414/686 |

* cited by examiner

*Primary Examiner* — Katy M Ebner
*Assistant Examiner* — Emma K Frick

(57) ABSTRACT

A parking stand arrangement for a tractor-mounted front loader includes a parking stand mounted to each of a pair of arm sections which are inclined downwardly and forwardly to a carried implement resting on the ground. Each parking stand includes a support leg and a brace, the latter being about half the length of the former and having a rear end pivotally mounted to a location approximately halfway between opposite ends of the support leg and an forward end pivotally mounted to a lower region of an associated loader arm section. The support leg and brace may be stored on the loader arm section by folding them together with a catch carried by the brace becoming releasably engaged with the support leg. The folded support leg and brace are then pivoted against the loader arm section and secured to it by a releasable latch which secures the top of the support leg to the arm section to establish a stored position. Movement of the parking stand from the stored position to a parked position includes the steps of releasing the latch and then the catch from the support leg and then unfolding the support leg and brace so that a hook at the top of the support leg is engaged with a mounting pin fixed to the loader arm section and a foot carried by the leg is engaged with the ground at a location rearward of the loader center of gravity.

6 Claims, 10 Drawing Sheets

FOLDING PARKING STAND

FIELD OF THE INVENTION

The present invention relates to parking stands for tractor front end loaders, and more specifically relates to such parking stands that are folded and stored on the loader when the loader is mounted to the tractor.

BACKGROUND OF THE INVENTION

Front end power loaders are commonly used on tractors and other mobile vehicles as attachments. When the loader is not to be utilized, it is dismounted and parked using the loader bucket or other attachment and a parking stand for support, thus permitting the tractor to be used for other operations unencumbered by the presence of the loader.

There are a multitude of different parking stand configurations, with the present invention being of the type which remains stored on the loader when not being used for parking the loader. Many of these known designs require that the operator remove and re-insert fastening pins in order to move the parking stand between stored and parking positions, which is not entirely satisfactory since it requires the operator to precisely align holes provided in the parking stand components with holes provided in the loader lift arm in order permit the fastening pins to be re-inserted. U.S. Pat. Nos. 4,257,730, 4,347,031 and 4,337,015 disclose parking stands of this type.

Other conventional parking stand designs are unable to accommodate the wide range of tire sizes used on larger tractor and loader combinations. Part of the problem with these designs stems from the fact that they include support legs having one end or the other pivotally attached to the loader boom or lift arm arrangement, thus limiting the flexibility of the support leg to be moved between stowed and parked positions without encountering interference with the tractor front wheels, especially when the opposite loader boom arms are spaced such that they overlap the space occupied by the front wheels.

Therefore, the problem to be solved is that of providing a parking stand design which overcomes the aforementioned drawbacks of the prior art designs.

SUMMARY OF THE INVENTION

According to the present invention, there is provided a novel parking stand for being mounted to a lift arm of a front loader.

An object of the invention is to provide a parking stand including a support leg and a brace pivotally connected together for movement between folded and unfolded positions and connected to a loader arm for being stored along a back side of the loader arm when folded, and for extending to the rear from the loader arm when in a parked position, with all fasteners associated with the loader arm remaining connected to the loader arm at all times.

The foregoing object is accomplished by providing the loader arm with a latch including a spring loaded latch member for selective engagement with a hole provided in an upper end region of the support leg when the parking stand is placed in the folded stored position, by providing the support leg with a catch for selectively securing the brace against the support leg, and by providing the upper end region of the support stand with a hook that may be engaged with a fixed pin carried by the loader at a location spaced below the latch when the brace and support leg are unfolded and placed in the parked position.

This and other objects will become apparent from a reading of the ensuing description together with the appended drawings.

DESCRIPTION OF THE PREFERRED EMBODIMENT

Figure 1:
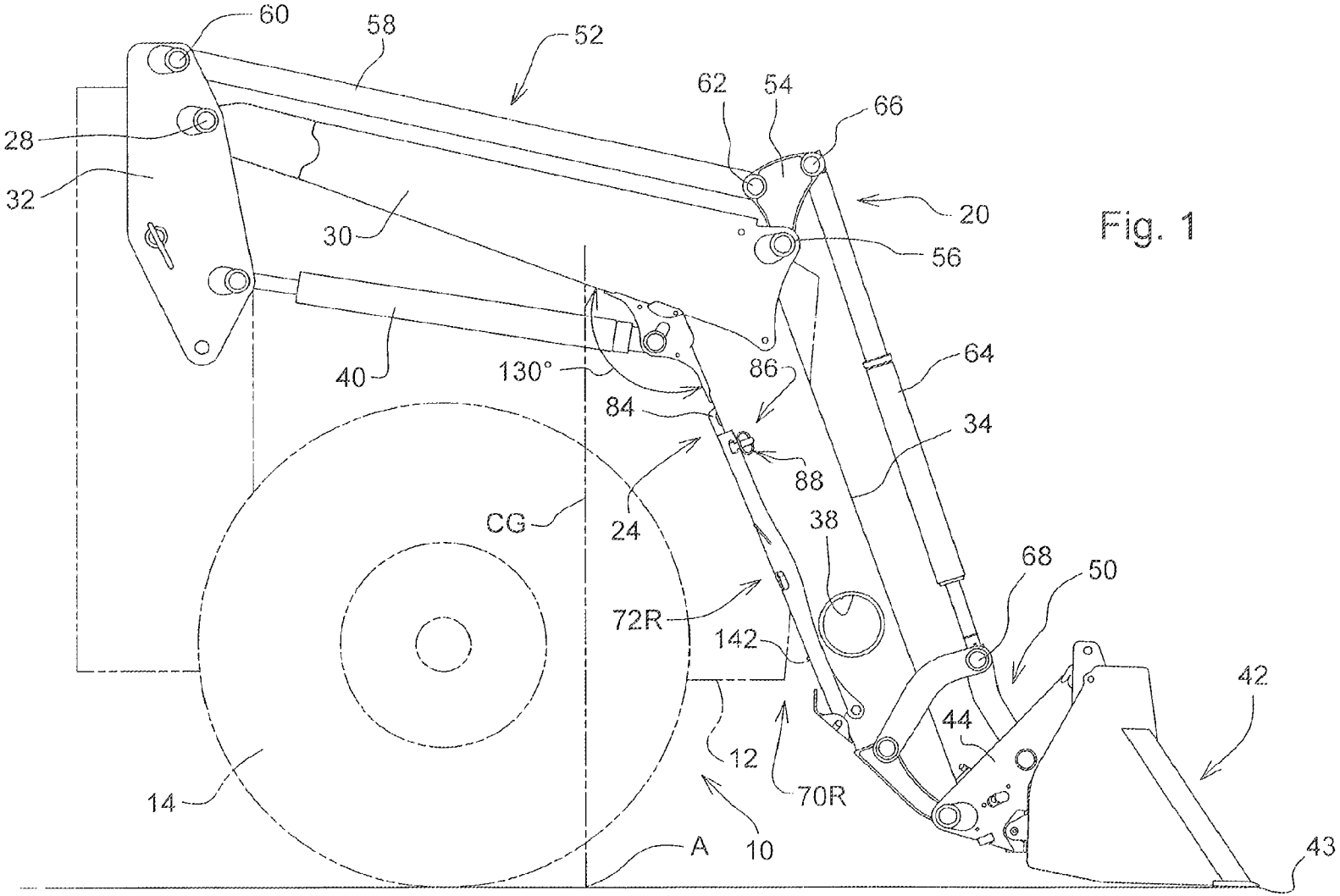
FIG. 1 is a right side view of a forward portion of a tractor showing a front end loader mounted on it and shown in a lowered condition preparatory to being parked.
Figure 2:
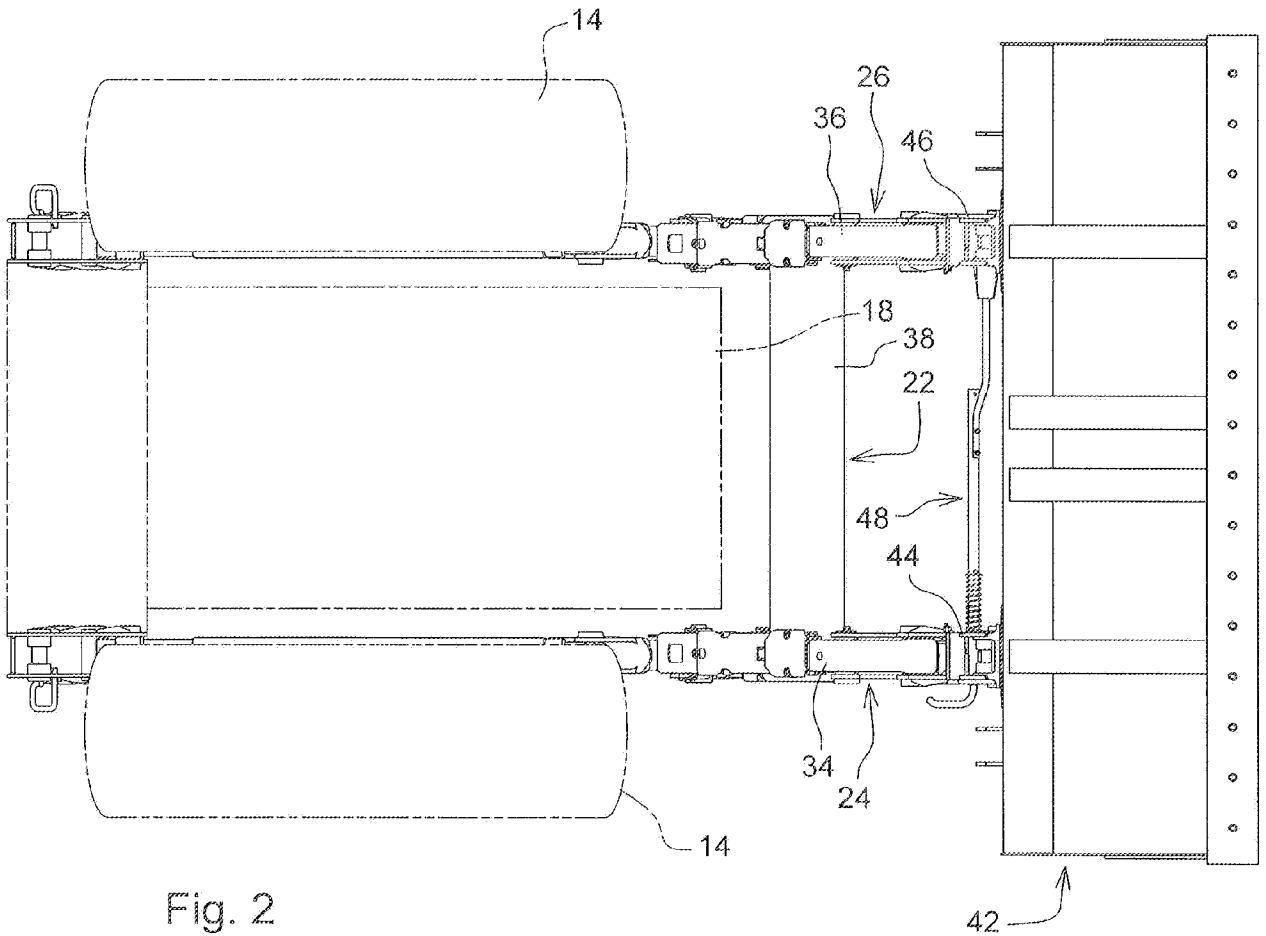
FIG. 2 is a bottom view of the tractor and loader of FIG. 1, showing the overlap between the front wheels of the tractor and the loader boom.

Referring now to FIGS. 1 and 2, there is shown, in phantom, a front end portion of a tractor 10 on which is mounted a front end loader 20. The tractor 10 includes a frame 12 having a forward end supported on a pair of front wheels 14, with an engine (not shown) being supported at a front end region of the frame and covered by a hood.

The loader 20 is of a conventional configuration including a loader boom 22 (FIG. 2) comprising transversely spaced, right and left, parallel loader arms 24 and 26, which with the boom in a lowered position, as viewed in FIG. 1, respectively include upper arm sections projecting forwardly from, and having rear ends respectively pivotally mounted, as at connection pins 28, to right and left masts, with only a right upper arm section 30 and right mast 32 being shown. Forward ends of the right and left upper arm sections extend just forwardly beyond front sides of the wheels 14 and are respectively coupled to upper ends of lower arm sections 34 and 36, which extend downwardly and forwardly so as to define an included angle of approximately 130° with the upper arm sections. Extending between, and joining the lower arm sections at locations spaced upwardly from lower ends of the arm sections is a cross member 38 defined by a cylindrical torque tube to the opposite ends of which may be applied a reinforcement, as shown at 39 in FIG. 3. Coupled between the right mast 32 and the junction between the upper and lower arm sections 30 and 34, respectively, is a right lift cylinder 40. A left lift cylinder (not shown) is similarly mounted between the left mast and the left lift arm 26.

Mounted to a lower front location of the lower arm sections 34 and 36 is an implement, here shown as a loader bucket 42 having a forward edge 43, with the bucket 42 extending transversely and having transversely spaced right and left mounting brackets 44 and 46, respectively, at its back side receiving the arm sections 34 and 36 and being secured to them by coupling pin portions of a spring-loaded latching device 48. Right and left tilt linkages, respectively, are coupled between the right lower arm section 34 and the bucket bracket 44, and between the left lower arm section 36 and the bucket bracket 46, with only the right tilt linkage 50 being shown. A right leveling linkage 52 is connected between the right mast 32 and the right tilt linkage 50, with an identical leveling linkage (not shown) being provided at the left side of the loader 20. Specifically, the leveling linkage 50 includes a generally triangular link 54 having a lower corner pivotally attached, as at pin 56, to an upper forward location of the upper arm section 30 of the right arm 24. An elongate link 58 has a rear end coupled, as at a pin 60, to an upper location of the mast 32 and a forward end coupled, as at pin 62 to a middle corner of the link 54. A hydraulic tilt actuator 64 has a cylinder end pivotally attached, as at pin 66, to an upper corner of the link 52 and has a rod end pivotally attached, as at pin 68, to the tilt linkage 50.

With reference to FIG. 1, it can be seen that the loader 20 has a center of gravity located in a vertical plane CG passing through the junctions of the upper and lower arm sections, through front regions of the wheels 14 and intersecting the ground at a location A ahead of the locations contacted by the wheels 14. Further, with reference to FIG. 2, it can be seen that the right and left arms 24 and 26 respectively overlap the right and left wheels 14. These facts have a significance explained below.

Up to this point, what has been described is the structure of a more or less conventional tractor front end loader.

Figure 12:
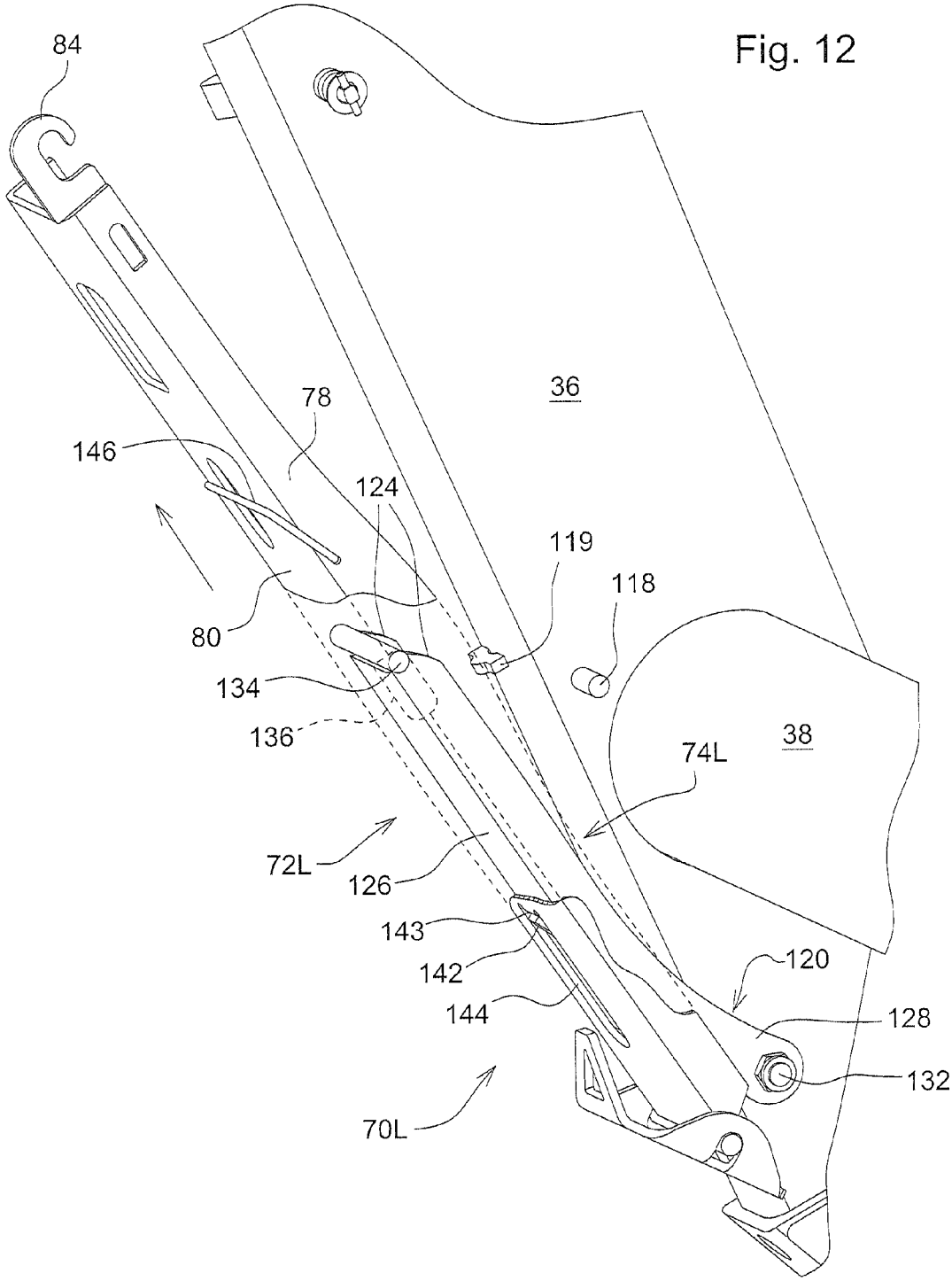
FIG. 12 is a right rear perspective view of an enlarged lower region of the left parking stand arrangement, with portions broken away, and showing a stage of deployment similar to that shown in FIG. 8 for the right parking stand.

Referring now also to FIGS. 3-7, it can be seen that the loader 20 is equipped with a right parking stand arrangement 70R including a right parking stand 72R shown mounted to the lower arm section 34 of the right loader boom arm 24. It is to be noted that FIG. 12 shows a left parking stand arrangement 70L including a left parking stand 72L and being constructed of parts identical to those used for constructing the right parking stand arrangement, with identical reference numerals being used for designating the identical parts.

The parking stand 72R comprises a support leg 74R including a major portion constructed as a channel 76 which is U-shaped in cross section, with opposite, upright flanges 78 of this major section being joined by a transverse web 80 having a width greater than that of the loader arm section 34 so that the flanges straddle the arm section 34 when the parking stand arrangement 70R is in a stored position, as shown in FIGS. 1-5. An upper region of the support leg 74R includes a pin receptacle defined by a forwardly opening hook 84 forming an upward extension of the left flange 78 of the leg 74R, as viewed in FIG. 3, and having an entrance sized for permitting passage of a mounting pin when the hook 84 is moved crosswise to the pin.

Figure 7:
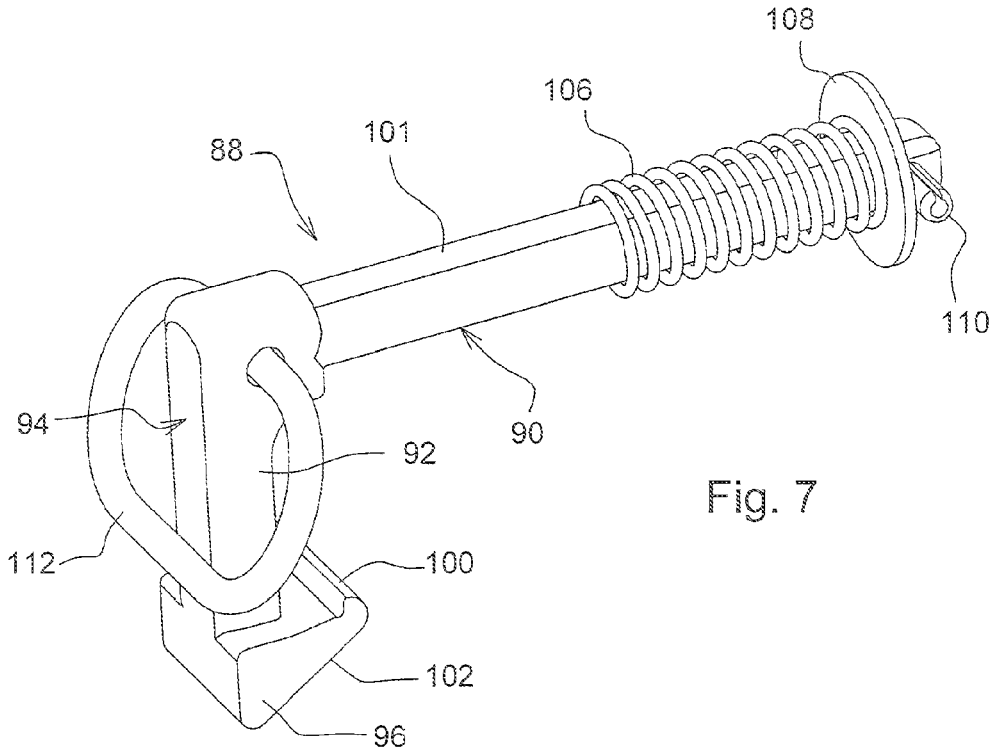
FIG. 7 is a perspective view of the latch shown in FIGS. 1-5.

A latch arrangement 86 is provided for securing the top of the parking stand leg 74R to the loader arm section 34 and includes a latch 88 comprising a rod 90 projecting inwardly through a transverse bore provided in the loader arm section 34 at a rear location approximately at the same height as that of the top of the wheel 14. Joined to, and making a 90° angle with, an outer end of the rod 90 is a top of a post 92 of a latch member 94 having a wedge-shaped foot 96 penetrating an elongate opening 98 provided in the right flange 78 of the channel 76 of the support leg 74R and having an upwardly curved toe 100 located on an opposite side of the channel side from the post 92. So that the latch member foot 96 remains properly oriented for entering the opening 98, the cross section of the rod 90 and that of the transverse bore in the loader arm section 34 are made of complementary non-round shapes. For example, the rod 90 shown in FIG. 7 is defined by an elliptical rod having flats 101 extending lengthwise on opposite sides of the rod. The transverse bore in the loader arm section 34 being a complementary shape. A bottom of the foot 96 is provided with an upwardly and inwardly inclined ramp surface 102 having a purpose explained below.

Figure 3:
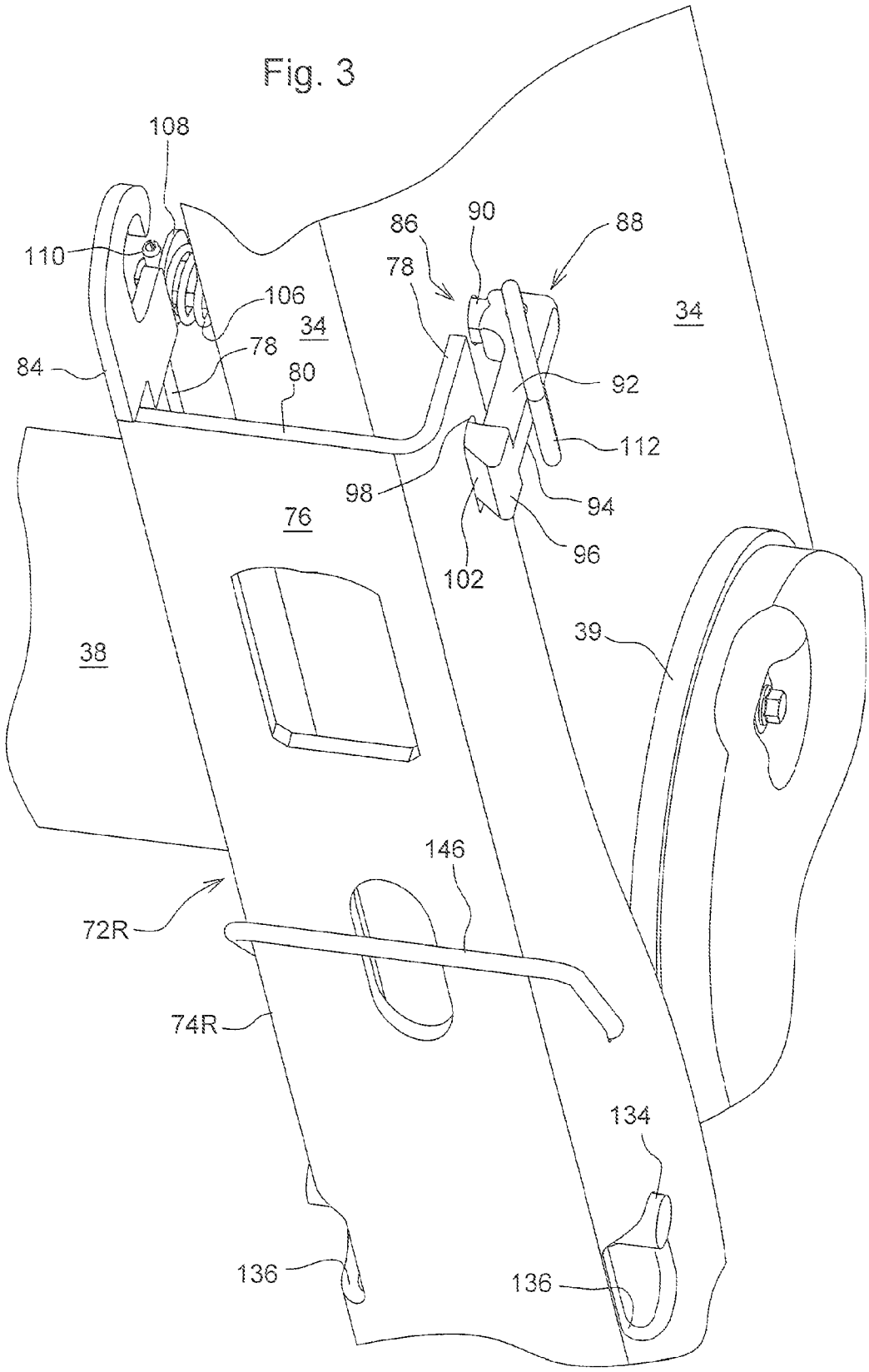
FIG. 3 is a right rear perspective view showing the connection of the top of the parking stand leg to boom arm carried latch when the parking stand is stored against the boom arm, but omitting the latch spring.
Figure 4:
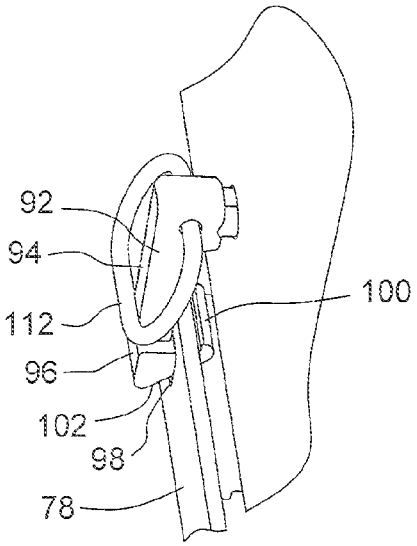
FIG. 4 is a top front perspective view of the connection shown in FIG. 3 revealing the fact that the latch foot projects through the opening provided in the parking stand leg.
Figure 5:
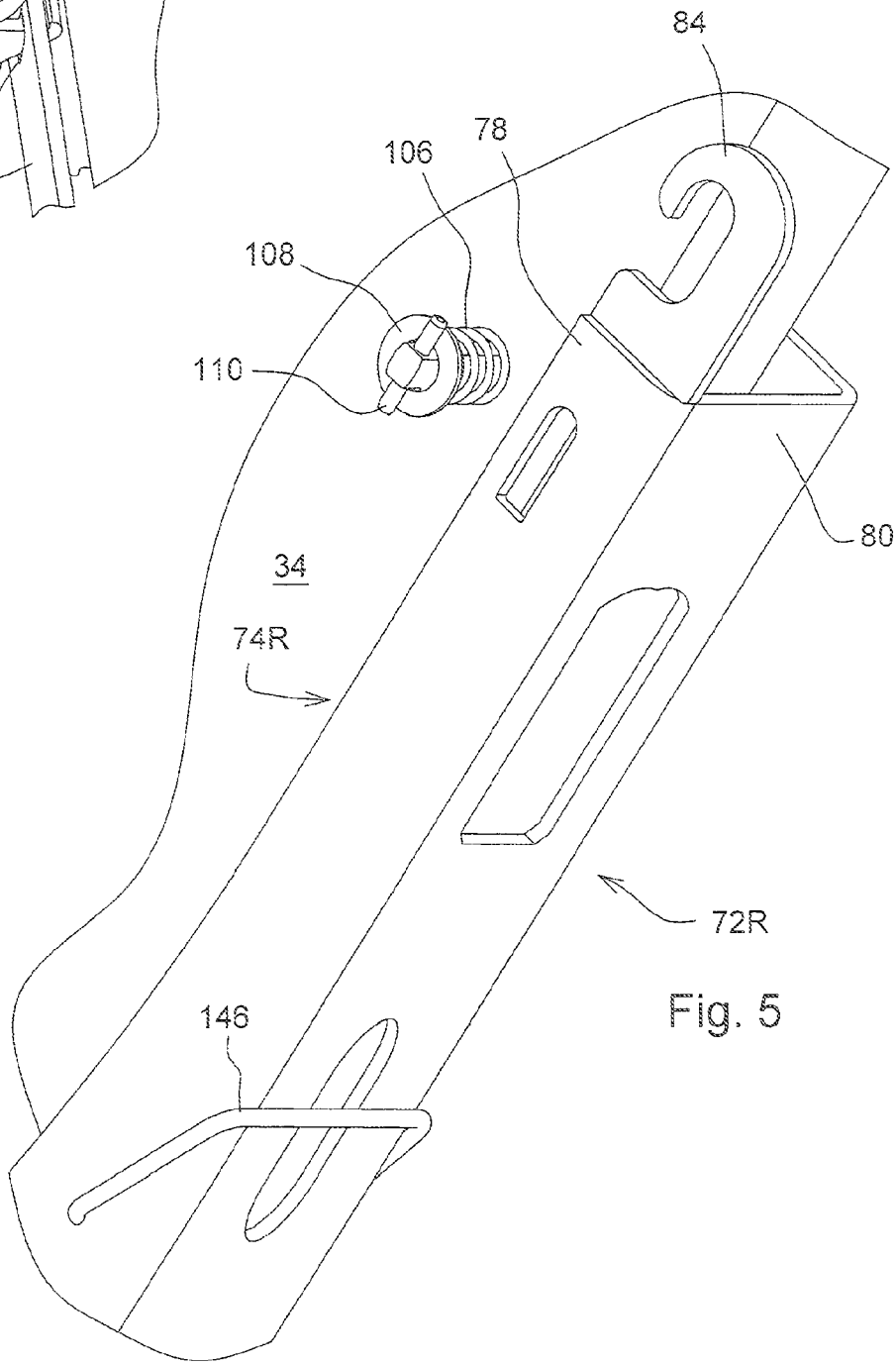
FIG. 5 is a left rear perspective view of the parking stand leg and boom arm carried latch shown in FIG. 3.
Figure 6:
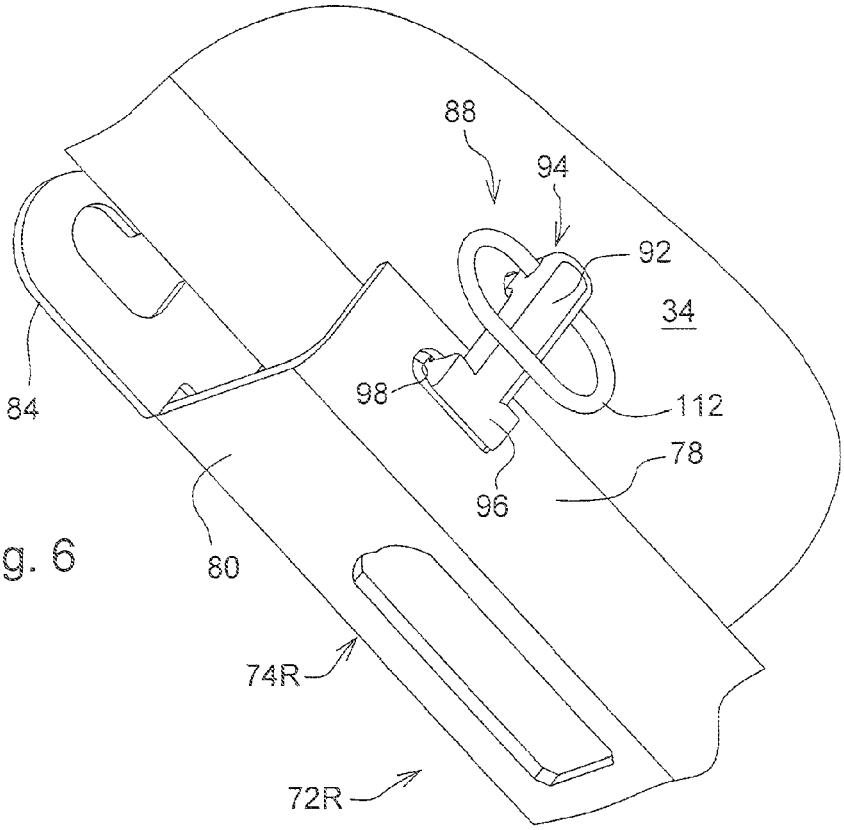
FIG. 6 is a view similar to that of FIG. 3, but more clearly showing the ramp surface of the pin guide member.

The inner end region of the latch member rod 90 projects through a coil compression spring 106, shown in FIGS. 3 and 7 and is compressed between an inner surface of the loader arm section 34 and a washer 108 received on the inner end of the rod 90 and held in place by a roll pin 110 extending through a cross hole provided in the rod 90. Thus, it will be appreciated that the spring 106 produces a biasing force that resists movement of the latch member foot 96 from the support leg opening 98. A pull ring 112 is received in a hole provided in a top region of the post 92 in alignment with the rod 90 so that an operator may pull the ring so as to exert a force that overcomes the spring 106 and disengages the latch member 94 from the support leg 74R.

As shown, the rod 90 and latch member 94 are in the form of a one-piece casting, but this need not be the case. For example, the rod could be constructed from a length of cylindrical rod having a first diameter with a second smaller rod being fixed along a part of its length to define the non-round cross section. The post could be defined by a flat strap welded to one end of the rod with the foot being in the form of a three-sided blank joined to and angled relative to an end of the post so as to define an inclined contact surface having the same function as the surface 102. An opposite end of the post from that to which the foot is attached could be formed with an extension defining a handle, having the purpose of the above-described pull ring 112 provided for being grasped by an operator.

Figure 8:
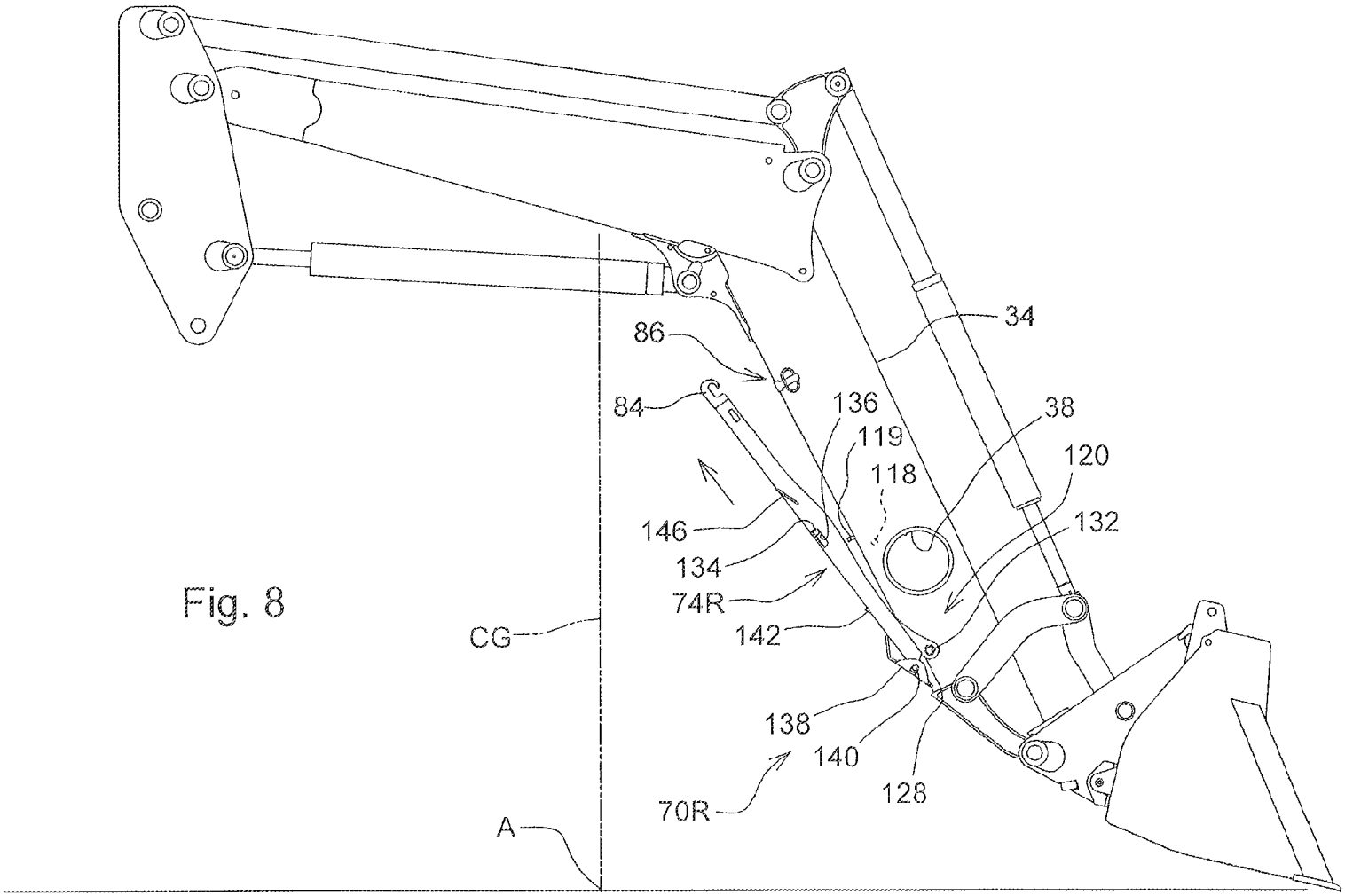
FIG. 8 is a right side view of the loader boom right arm and associated parking stand showing an initial step in moving the parking stand from the stored to the parked position, wherein the bucket is in ground contact, with the main latch being released and the stand pivoted counterclockwise about the pivotal connection of the strut with the boom arm.
Figure 9:
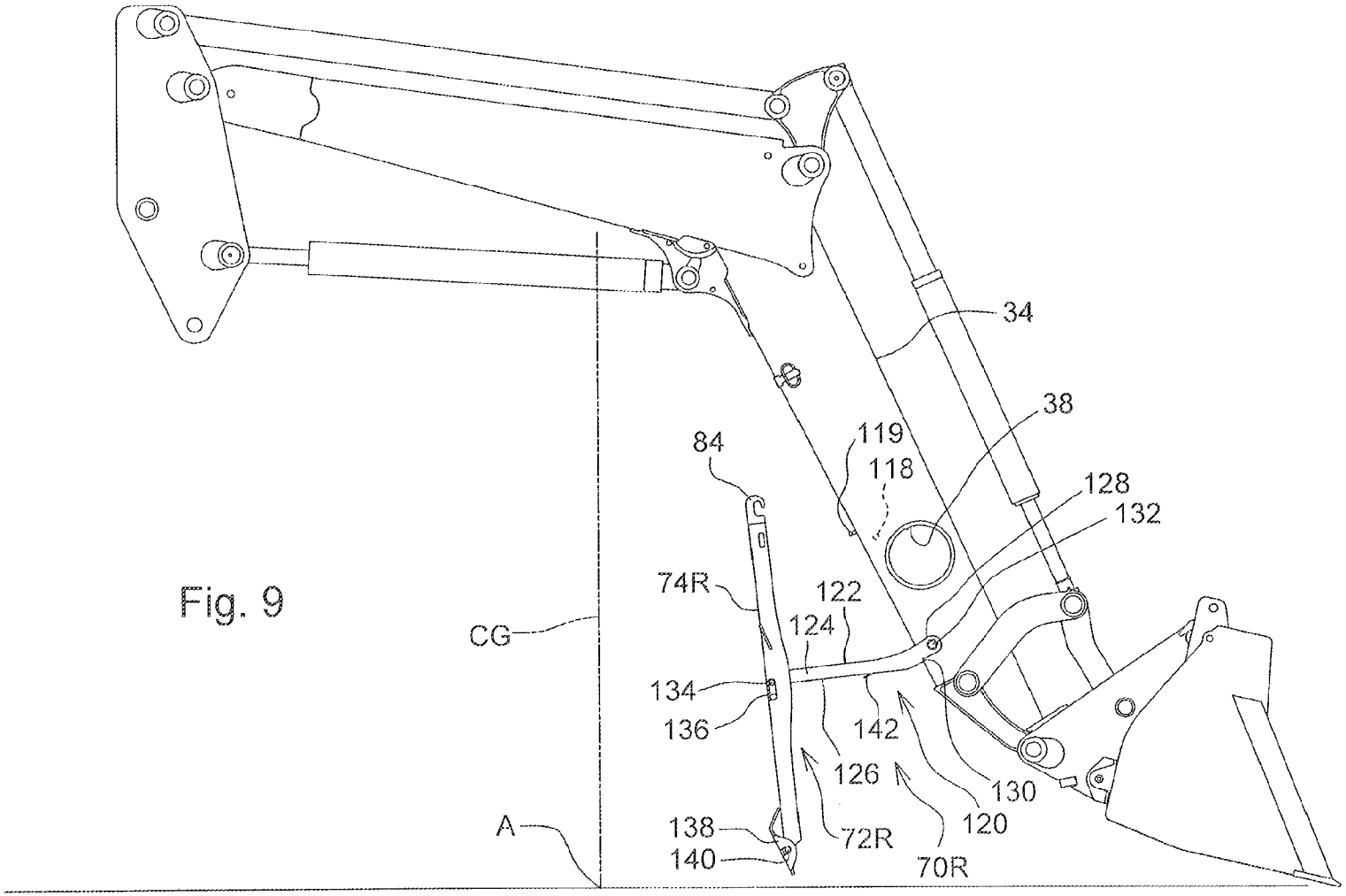
FIG. 9 is a view like FIG. 8, but showing the support leg and strut positioned after performing a second step wherein the support leg of the parking stand has been rotated clockwise about its connection with the brace to a substantially vertical position while lowering the brace to a substantially horizontal position.
Figure 10:
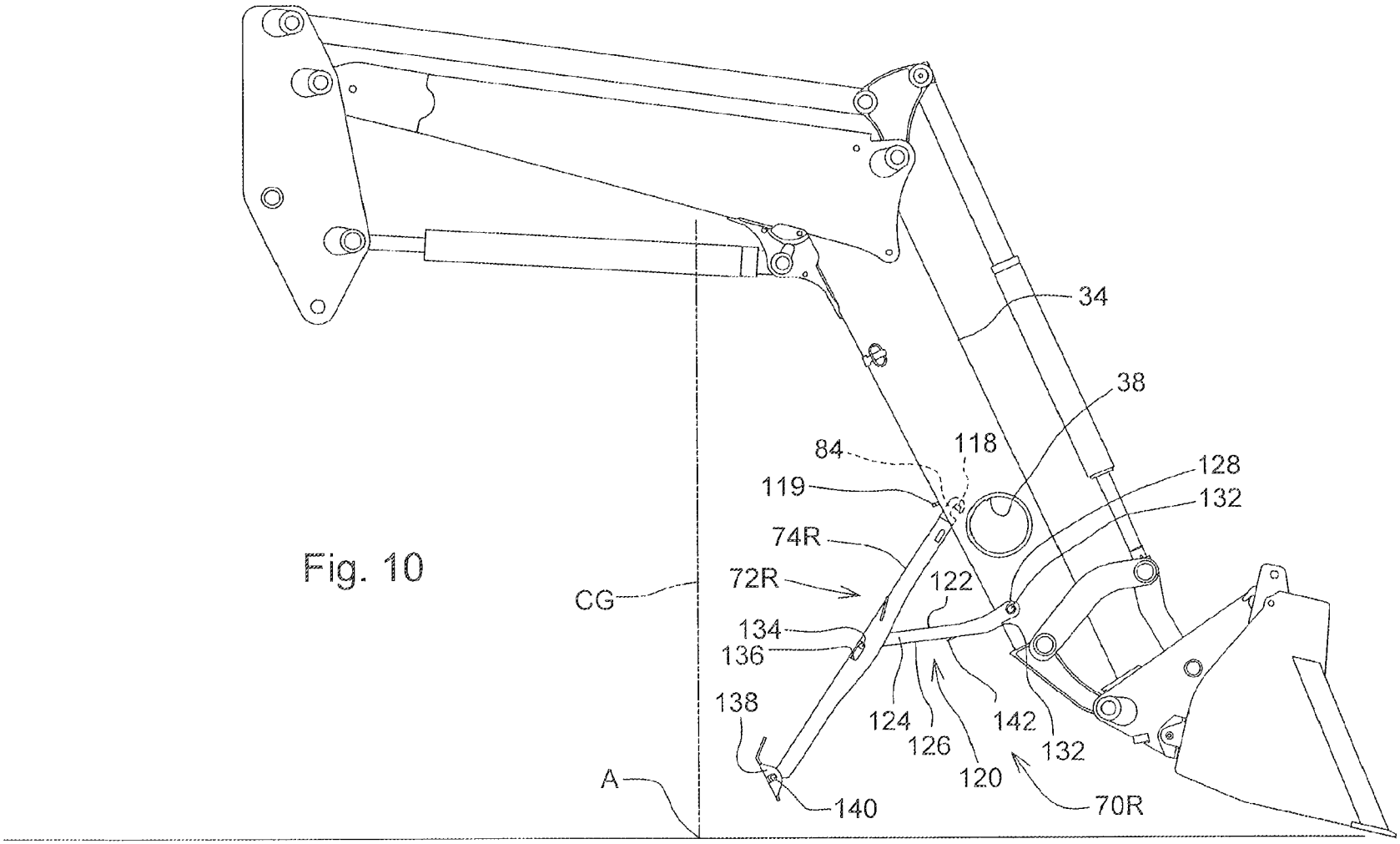
FIG. 10 is a view like FIG. 9, but showing the support leg and strut positioned after performing a third step wherein the support leg of the parking stand has been rotated clockwise from its near vertical position so as to bring the hook at the top of the support leg into engagement with the stand retaining pin provided on the inside of loader boom arm.
Figure 11:
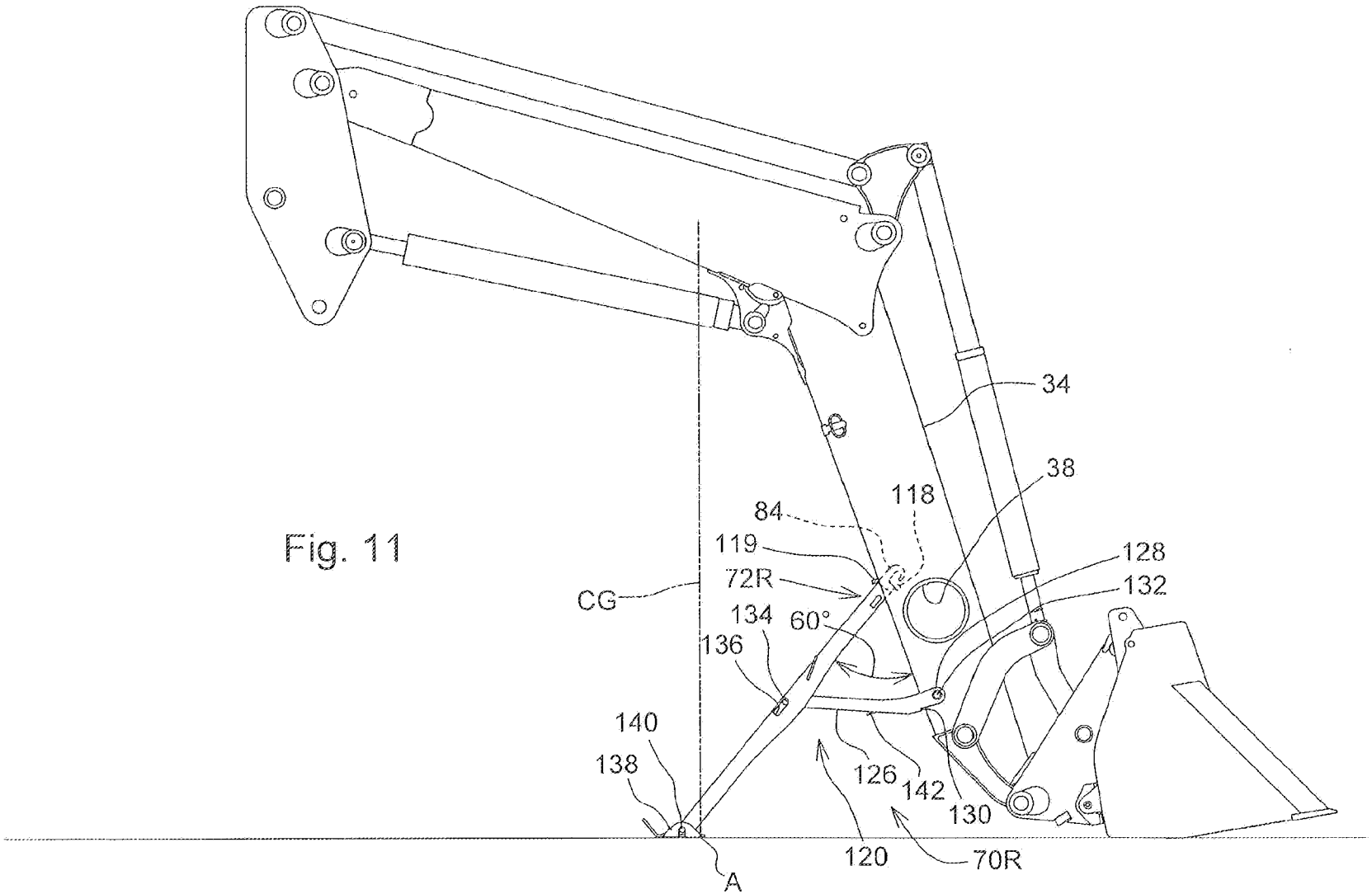
FIG. 11 is a view like FIG. 10, but showing the loader bucket rolled back with the top of the web of the support leg channel in engagement with a stop fixed to a backside of the loader boom arm.

Referring now also to FIGS. 8-12, it can be seen that when steps taken to deploy the parking stand 72R have reached the stage shown in FIG. 10, the hook 84 on the left channel flange 78 will be engaged with a mounting pin 118 welded to, and projecting inwardly from, a rear location of the left or inner surface of the loader arm section 34 at a height approximating that of the loader cross member 38. Further, it can be seen that a stop 119 is fixed to the back side of the loader arm section 34 at a height approximately equal to that of the pin 118 so that the stop 119 engages the top of stand channel member 76 when the parking stand 72R is fully deployed, as shown in FIG. 11.

A brace or strut 120 is formed primarily of a channel 122 having opposite flanges 124 joined by a web 126 having a width approximately equal to that of the loader arm section 34. Forming continuations of the flanges 124 are rounded forward extensions 128 which extend beyond a forward end 130 of the web in straddling relationship to the arm section 34 to which the brace 120 is vertically pivotally mounted by a pin 132 which is located in aligned holes provided in the arm section 34 and brace extensions 128. Joined to a rear end of the web 126 and flanges 124 is a transversely extending mounting pin 134 having opposite end regions respectively located in elongate holes 136 provided in the flanges 78 of support leg 74R at respective locations approximately half-way between opposite ends of the leg 74R. The brace 120 has a generally horizontal disposition, as viewed in FIGS. 9-11, and when so disposed is prevented from pivoting further downward due to the fact that the web end 130 is then in engagement with the arm section 34. The length of the brace 120 is such that no interference exists between the leg 74R and the wheel 14 as the support leg 74 is moved from its stored position (FIG. 1) to the parked or deployed position (FIG. 11). When the support leg 74R is located in the parked position, it makes an angle of about 60° with the loader arm, section 34 and, a foot 138 that is pivotally attached, as at pin 140, to a bottom location of the support leg, engages the ground at a location slightly to the rear of the location A where the plane CG containing the loader center of gravity intersects the ground. Further, when considered in this disposition, the brace 120 includes a catch 142, defined by a narrow tab formed as a three-sided blank bent downwardly from a remaining portion of the web 126 at an intermediate location between opposite ends of the brace 120 so as to diverge from the web in the direction of the pin 134. When the support leg 74R and the brace 120 are pivoted relative to each other so that the brace 120 nests within the support leg 74R, as shown in FIG. 8, or the brace 120 nests within the support leg 74L, as shown in FIG. 12, for example, the catch 142 will abut an end and an outer surface of a three-sided tab 143 formed at, and projecting downwardly and forwardly from, the upper end of an elongate opening 144 provided in the web 80 of the support legs 74R or 74L, with the only showing of the opening 144 being that of the left parking stand 72L in FIG. 12. It is to be understood that this structure is identical in the right parking stand 72R. This condition also exists when the parking stand 72L is in its stored position similar to that of the parking stand 72R, shown in FIG. 1.

It will be appreciated that the respective tabs 143 of the support legs 74R and 74L can each be disengaged from the respective catches 142 by pulling upwardly on the respective stand legs 74R and 74L, with it being noted that the elongate holes 136 in the legs 74R and 74L permit this movement. To aid in this operation, the support legs 74R and 74L are each provided with a formed wire defining a generally U-shaped, torsion spring loaded handle 146 received for pivoting in axially aligned holes provided in the flanges 78 of each of the legs 74R and 74L at a location spaced above the elongate holes 136.

The operation of the parking stand arrangements 70R and 70L is as follows. Beginning with the loader 20 mounted on the tractor 10 and with the parking stands 70R and 70L each being in a stored position, as shown in FIG. 1, the associated braces 120 of the support legs 74R and 74L will be in fully raised positions wherein they are nested within the associated leg and retained in the nested position by the catches 142 of the braces 120, with each catch being engaged with the bent tab 143 at to top of the hole 144 provided in the web 80 of the associated leg 74R or 74L. The legs 74R and 74L and the respective nested braces 120 are secured to the associated boom arm section 34 or 36 by the associated latch arrangement 86, wherein the foot 96 of the latch member 88 is received within the opening 98 provided in the associated support leg 74R or 74L and retained there by the action of the spring 106.

If it is then desired to take the loader 20 off the tractor 10, the tractor is driven to a desired location for parking the loader 20 and the lift cylinders 40 and tilt cylinders 64 are operated to place the bucket 42 in a dump position. The boom 24 is then lowered until the bucket edge 43 engages the ground and the tractor weight is transferred from the front wheels 14 onto the bucket edge 43, as shown in FIG. 8. Next the operator will dismount from the tractor 10 and deploy the parking stands 72R and 72L, with only the description for deploying the parking stand 72R at the right side of the loader being described. Specifically, the operator will simultaneously grasp the pull-ring 112 with one hand and the handle 146 with the other hand. An outward force is then exerted on the pull ring 112 so as to overcome the force of the spring 106 and withdraw the foot 96 from the hole 98 provided in the support leg flange 78 so as to unlatch the top of the support leg 74R. Once the support leg 74R is released, the operator can pull up on the handle 146 in the direction of the arrow, thereby lifting the leg relative to the brace 120, as permitted by the elongate openings 134, releasing the leg tab 143 from the brace catch 142.

The support leg 74R is then pivoted clockwise about the mounting pin 134, while lowering the support leg 74R together with the brace 120 until the web end 130 of the brace engages the loader arm section 34, as shown in FIG. 9. The operator will continue to rotate the support leg 74R clockwise about the pin 134 until the hook 84 receives the inner end region of the pin 118. The condition of the parking stand 72R shown in FIG. 10 will then exist. A like procedure is then followed to deploy the parking stand 72L. The pins which secure the right mast 32 and the corresponding left mast (not shown) to the tractor mounting frame are then manipulated to release the loader 20 from the tractor.

The operator will then mount the tractor 10 and effect retraction of the tilt cylinders 68 so as to roll back the bucket 42 in order to place weight on the parking stands 72R and 72L, with the top of the web 80 of each of the support legs 74 becoming firmly engaged with the respective abutments 119. The entire loader then rotates about the parking stand foot 138 as the bucket keeps rolling back. The condition of the parking stand 72R shown in FIG. 11 will then exist for both parking stands and the masts will be clear of the mounting frames. The loader 20 is thus detached from the tractor 10.

Parking of the loader 20 is then completed by uncoupling the loader hydraulic system from the tractor 10 and backing the tractor away, as is well known in the art. It is noteworthy that, should the loader 20 be parked in an outdoor location in climates having snow and/or wind, the respective orientations of the support legs 74R and 74L and the associated braces 120 are such that the webs of each of the leg and strut define the top sides of the channels so that snow and/or ice or wind borne dirt and/or debris will not collect in the channels and cause any problems affecting the folding of the parking stands 72R and 72L when the loader is again coupled to the tractor for use.

The loader 20 can be reconnected to the tractor 10 by following the above described procedure in reverse order. Except it should be noted that, when latching the top of the support legs 74R and 74L of the stands 72R and 72L to the boom arm sections 34 and 36, it is not necessary for the operator to manipulate the latch by pulling on the pull-ring 112, but rather the operator needs only to pivot the support legs 74R and 74L upwardly about the connecting pins 134 to so as to engage the associated flanges 78 of the legs 74R and 72L against the ramp surface 102 of the respective latch member 94 so as to cause the latch 88 to shift outwardly against the bias of the spring 106, with further upward movement aligning the flange opening 98 with the nose 100 of the foot 96, whereupon the spring acts to move the nose 100 through the opening, thus latching the legs 74R and 74L to the boom arm sections 34 and 36.

Having described the preferred embodiment, it will become apparent that various modifications can be made without departing from the scope of the invention as defined in the accompanying claims.

The invention claimed is:

1. In a combination of a parking stand together with each of a pair of downwardly and forwardly inclined lower arm sections respectively of a pair of front loader lift arms and to forward ends of which an implement is coupled, the parking stand including a support leg and a brace having opposite ends respectively pivotally mounted to the support leg and to one of said pair of lower arm sections, with the support leg and brace being movable between a folded stored position wherein said support leg and brace extend alongside each other and are fixed to said one of said pair of lower arm sections, and an unfolded parked position, wherein said support leg extends down and to the rear from said one of said pair of lower arm sections while said brace extends between the latter arm section and the support leg, the improvement comprising: a first mounting pin being fixed to, and projecting laterally from, one side of said one of said pair of lower arm sections at a location which is above where said brace is pivotally mounted; said support leg having an upper end region including a receptacle, with said receptacle being engaged with said first mounting pin when said parking stand is in said parked position; a releasable latch being mounted to said one of said pair of lower arm sections at a location spaced above said first mounting pin and being engaged with said upper end region of said support leg when said parking stand is in said stored position; said support leg and said brace each including a major channel portion including a web and flanges and which opens toward said one of said pair of lower arm sections; said brace being dimensioned such that opposite flanges of said brace are located at opposite sides of said one of the loader arm sections and are nested between opposite flanges of said support leg with the webs of the support leg and brace being adjacent each other when said parking stand is in said stored position and with one of the opposite ends of the brace being defined by extensions of the flanges which straddle and are pivotally connected to, said one of said lower arm sections to thereby establish the pivotal mounting between the brace and the one lower arm section, and with another of the opposite ends of the brace having a transversely extending second mounting pin joined thereto and having a lost-motion coupling with a location of said support leg approximately midway between opposite ends of the support leg, with said lost motion coupling guiding said second mounting pin for movement lengthwise of said support leg and for defining the pivotal connection between the brace and support leg; the webs of said brace and said support leg respectively having cooperating catch and tab surfaces formed thereon for being engaged with each other so as to prevent pivotal movement of the support leg about the second mounting pin when the support leg and brace are folded together and the support leg is positioned on the second mounting pin such that the upper end region of the support leg is properly spaced from the pivotal connection of the brace with said one of the pair of lower arm sections for being engaged with the releasable latch when the support leg and brace are pivoted together toward said stored position.

2. The combination, as set forth in claim 1, wherein said receptacle of said support leg is defined by a forwardly opening hook, with said hook being received on said mounting pin when said parking stand is in said parked position.

3. The combination, as defined in claim 1, wherein said forward extensions of the opposite flanges of said brace extend forwardly beyond a forward end of the web of said brace and with said end of said web being in engagement with said one of said pair of lower arm sections and acting to prevent said brace from pivoting downwardly beyond an approximate horizontal position which said brace occupies when said parking stand is in said parked position.

4. In a combination of a parking stand with each of a pair of downwardly and forwardly inclined lower arm sections respectively of a pair of front loader lift arms and to forward ends of which an implement is coupled, the parking stand including a support leg and a brace having opposite ends respectively pivotally mounted to the support leg and to one of said pair of lower arm sections, with the support leg and brace being movable between a folded stored position wherein said support leg and brace extend alongside each other and are fixed to said one of said pair of lower arm sections, and an unfolded parked position, wherein said support leg extends down and to the rear from said one of said pair of lower arm sections while said brace extends between the latter arm section and the support leg, the improvement comprising: a mounting pin being fixed to one side of said one of said pair of lower arm sections at a location which is above where said brace is pivotally mounted; said receptacle being engaged with said mounting pin when said parking stand is in said parked position; a releasable latch being mounted to said one of said pair of lower arm sections at a location spaced above said mounting pin and being engaged with said upper end region of said support leg when said parking stand is in said stored position; and said upper end region of said support leg including a flange containing a latch opening and being disposed closely adjacent to, and alongside said one of said pair of lower arm sections when the support leg and brace are in the folded stored position; and said latch including a latch member having a foot shaped complementary to said latch opening and being yieldably biased into engagement with said one of said pair of lower arm sections at a location in a path of movement of said flange and latch opening as the support leg is moved toward said stored position, with said foot including an angled surface located for engagement by said flange which lifts the foot for being received in said opening when said parking stand is moved into said stored position.

5. The combination, as defined in claim 4, wherein said latch includes a rod extending transversely through said one of said pair of lower arm sections, a post including said foot being joined to one end of the rod; and a biasing element acting on said rod for resisting movement of said foot of said latch member from said latch opening when said parking stand is in said stored position.

6. The combination, as defined in claim 4, wherein said lost motion connection comprises a pair of parallel slots respectively provided in the flanges of the support leg and receiving opposite ends of said second mounting pin.

* * * * *